US005499874A

United States Patent [19]

Tang

[11] Patent Number: 5,499,874

[45] Date of Patent: Mar. 19, 1996

[54] BAG HAVING EXPANDING APPARATUS THEREIN

[76] Inventor: Hin M. Tang, 10 Banksia Street, Eastwood NSW 2122, Australia

[21] Appl. No.: 317,935

[22] Filed: Oct. 3, 1994

[51] Int. Cl.[6] ..... A45C 7/00

[52] U.S. Cl. ..... 383/127

[58] Field of Search ..... 383/33, 35, 104, 383/119, 127

[56] References Cited

U.S. PATENT DOCUMENTS

| | | |
|---|---|---|
| 1,206,618 | 11/1916 | Thrasher et al. . |
| 2,542,477 | 2/1951 | Cart . |
| 4,077,451 | 3/1978 | Zoland . |
| 4,141,399 | 2/1979 | Zoland . |
| 4,796,734 | 1/1989 | Distasio . |
| 4,813,520 | 3/1989 | Lin . |
| 4,946,292 | 8/1990 | Diamond et al. . |
| 4,949,401 | 8/1990 | Kimsey, Jr. . |
| 4,953,673 | 9/1990 | Ambasz . |
| 4,969,751 | 11/1990 | Diamond et al. . |
| 4,993,846 | 2/1991 | Diamond et al. . |
| 5,090,526 | 2/1992 | Jacober . |
| 5,322,362 | 6/1994 | Smith ..... 383/127 |

*Primary Examiner*—Allan N. Shoap
*Assistant Examiner*—Jes F. Pascua
*Attorney, Agent, or Firm*—Joel F. Spivak

[57] ABSTRACT

An apparatus for insertion into and expansion of a soft bag or backpack has a relatively flat foldable member comprising three parallel fold lines forming four panels. A rubber band is connected across two of the panels so as to urge the member to fold along the fold lines therebetween. The bag is caused to be expanded by the apparatus when the rubber bands urge the member to fold into an expanded state when the bag is removed from its carton. One panel of the device is of the size and shape of a major face of the bag and is provided with a large hinged flap which, when in the expanded state is caused to form a structure having a triangular cross section.

11 Claims, 3 Drawing Sheets

BAG HAVING EXPANDING APPARATUS THEREIN

FIELD OF THE INVENTION

This invention relates to expandable soft bags or back-packs for display at the point of sale. More particularly, this invention relates to a soft bag having an apparatus therein which either automatically or manually expands the bag to give the impression that the bag is filled.

BACKGROUND OF THE INVENTION

Soft bags, such as suitcases, tote bags, sport bags and back-packs, of all sizes and types are presently manufactured throughout the world. The bags are transported from the manufacturer to their destination in a flatly packed or nested state so as to take up minimal shipping space thereby reducing the cost of shipping. As most retailers prefer to sell and/or display these bags fully stuffed for marketing purposes, the retailer often arranges for the bags to be stuffed and repacked at a stuffing facility located near the final destination or at the point of sale.. To accomplish this, the bags must be removed from their original shipping cartons, manually stuffed, such as with crumpled paper, stiff cardboard, inflated members or other means, and then repacked in larger cartons that will hold the stuffed bags. Such stuffing increases the cost of the bags and additionally creates storage problems.

As a result of the problems associated with manually stuffed bags, there has been introduced into the market insertable apparatus that permits a bag to be retained in a flat state for shipping and then, automatically or manually, allows the bag to be easily and quickly expanded by the retailer. Such insertable apparatus eliminates the costly stuffing process for display or sales purposes while still retaining the savings associated with the ability to ship or store the bags in a flat state. Typically, such expandable member has been made from corrugated cardboard and is urged into the desired state by appropriately positioned resilient means, e.g. rubber-bands. Exemplary of such apparatus are those described in U.S. Pat. Nos. 4,077,451; 4,141,399; 4,946,292; 4,969,751; and 4,993,846.

While the insertable apparatus set forth in these patents are adequate to fulfill the need for an alternative to stuffing, simpler, less costly and/or more effective designs are always desirable.

SUMMARY OF THE INVENTION

The present invention comprises a foldable and expandable apparatus used in combination with, and insertable in, a soft bag for allowing the bag to be shipped in a compact, flat state and to be later automatically changed to an expanded state. The apparatus comprises a unitary flat foldable member having resilient or elastic actuating means. The unitary flat foldable member is provided with three parallel, spaced, fold lines so as to form four panels including: a first narrow panel; a second, generally relatively large panel adjacent the first panel and which preferably conforms to the shape and height of a major face of the bag into which it is to be inserted, this panel is cut so as to form a large central flap preferably extending the width of the panel; a third panel, adjacent the second panel, having a width slightly less than the width of the base of the bag into which it is to be inserted; and a fourth panel, adjacent the third panel and having a width about the same as that of the third panel and optionally having a small, preferably centrally located flap for engaging the large flap of the second panel when in the expanded state. The third and fourth panels are provided with means for securing an elastic member thereacross in a manner so as to allow the apparatus to be maintained in a relatively flat state, when an external force is applied thereto (such as when confined by the shipping container), and thereafter to automatically (or with some manual assistance) be urged and retained by said elastic means in an expanded state. In the expanded state, the frame of the second panel and its large flap form a gable-like structure with the third and fourth panels providing a base for the structure thereby urging the bag to expand and appear filled.

DETAILED DESCRIPTION OF THE INVENTION

Figure 1:
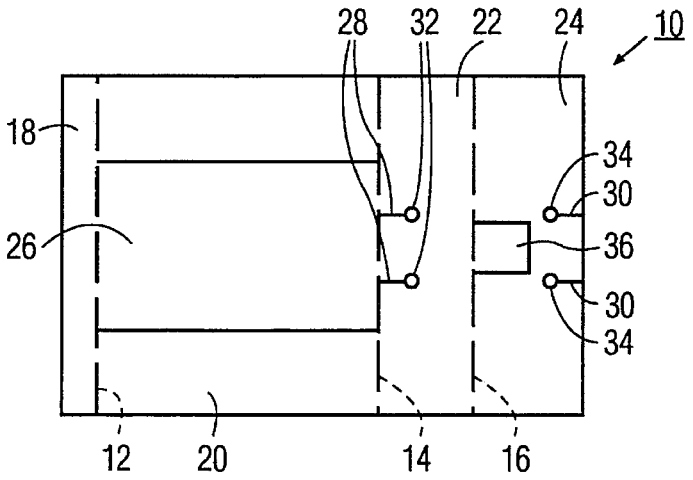
FIG. 1 is a top plan view of an embodiment of the invention showing a novel bag expansion apparatus in a flat, unfolded state without any resilient means attached thereto.

As shown in FIG. 1, the apparatus of the present invention comprises a flat foldable member 10 which may be made from heavy cardboard, corrugated board or other suitable rigid material such as plastic, The member 10 is provided with three parallel, spaced fold lines 12, 14 and 16 which divide the member into four panels 18, 20, 22 and 24, The first panel 18 is a relatively narrow panel and will form the top of the apparatus in its expanded state, Second panel 20 is a relatively large panel adjacent the first panel 18 and is preferably of a size and shape to conform to the size and shape of a major surface of a bag 60 (see FIG. 6) to be expanded. This second panel 20 is cut so as to form a large central flap member 26 extending the width of the panel 20 and which is hinged at the first fold line 12. Panel 20 and its flap 26 form the sides of the apparatus in its expanded state. The third panel 22 and adjacent fourth panel 24 having fold line 16 therebetween form the base of the apparatus in its expanded state and have a width so as to fit into the base of the bag 60. Panels 22 and 24 are each provided with means for securing an elastic member. One example of such means comprises a pair of spaced, preferably centrally located, parallel slits 28 and 30 respectively. Slits 28 in third panel 22 extend outwardly from fold line 14 where the panel 22 meets panel 20 toward fourth panel 24. The slits 28 terminate in elastic retention holes 32 preferably from one third to one half the width of the panel 22. Slits 30 in fourth panel 24 extend inwardly from the outer edge of the panel 24 and terminate in elastic retention holes 34 preferably located from one third to one half the width of the panel 24 from its edge. Alternatively, the means for securing the elastic member can be a staple, a hole through which the elastic member is placed and then knotted or otherwise prevented from passing back therethrough, or any other means known in the art which is useful for securing an elastic member to a rigid body. Fourth panel 24 is also preferably provided with a small, preferably centrally located flap or tab 36 extending partially into the panel 24 from fold line 16 where the flap 36 is hinged. It should be noted that the first fold line 12, may optionally extend only for the width of the flap 26 (see FIG. 7).

Figure 2:
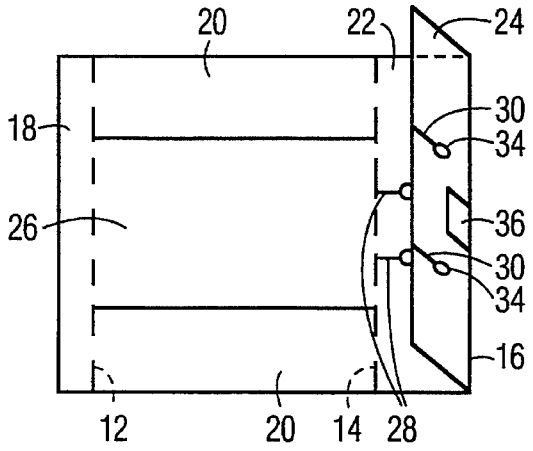
FIG. 2 is a top plan view of the apparatus shown in FIG. 1, partially folded to implement insertion of resilient or elastic means, e.g. a rubber band , thereto.
Figure 3:
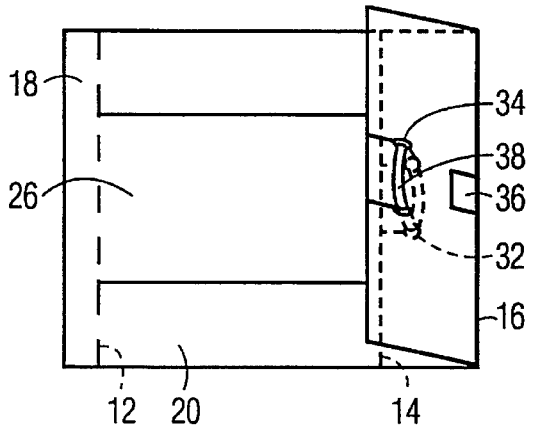
FIG. 3 is a top plan view [views] of the apparatus of FIG. 1 with attached rubber band.
Figure 4:
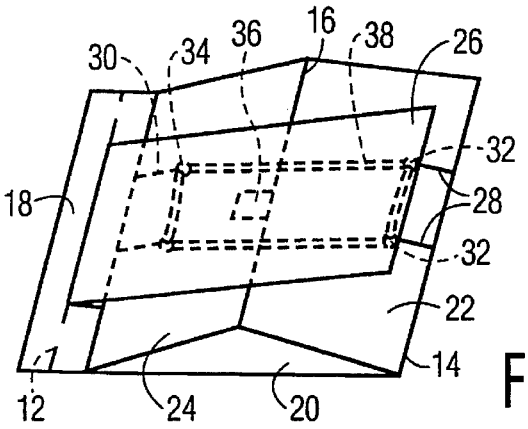
FIG. 4 is an isometric view of the apparatus shown in FIG. 1 with the elastic material in its compressed state as it would appear during shipping.

Referring to FIG. 2, the apparatus 10 is shown with panel 24 partially folded toward panel 22 to facilitate attachment of elastic means, e.g. a rubber band 38 through the pairs of parallel slits 28 and 30 so that it is retained in the pairs of respective retention holes 32 and 34 as shown in FIG. 3. During shipment from the manufacturer, bag 60 will be placed flat in a container with other bags. The container will be completely filled with bags to maximize shipping space and reduce shipping costs. If the bags contain the apparatus of this invention folded as shown in FIG. 4, the apparatus will be maintained in a compressed state due to the filled container which provides the force necessary to counteract the force of the elastic band 38 and hence will be retained in its flat configuration. Upon removal from the container, the compressive force will be relieved and the panels 22 and 24 will be urged by the elastic band 38 to assume a position as described in FIG. 5, giving the bag a filled appearance.

FIG. 4 shows the apparatus 10 in its essentially compressed state as it would appear inside of a bag compressed by the carton or other container for the bag. As can be seen, in this compressed state, third and fourth panels 22 and 24 are folded to lie under the flap 26 formed in second panel 20 by folding along fold line 14. Third and fourth panels 22 and 24 are not folded with respect to each other in this position. Further, when in this compressed state, rubber band 38 is fully stretched so as to provide a force which tends to urge panels 22 and 24 to fold along fold line 16 therebetween. This is prevented by the compressive force of the container for the bag 60.

Figure 5:
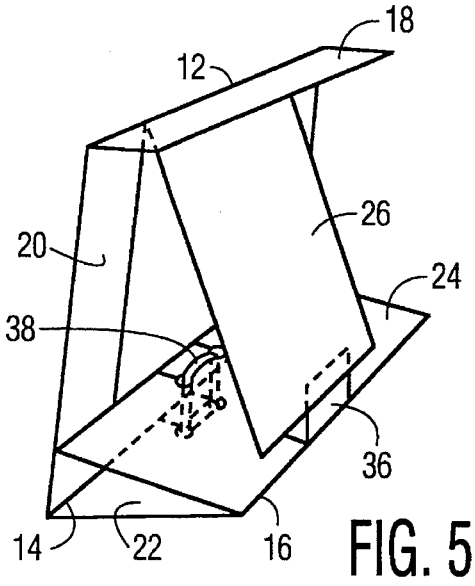
FIG. 5 is an isometric view of the apparatus of FIG. 1 in its expanded state as it would appear after removal of the compression force.
Figure 6:
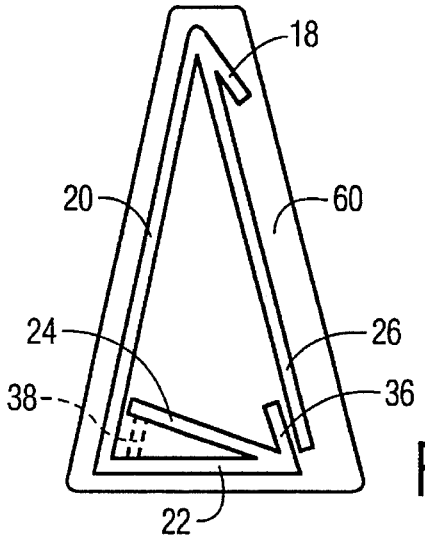
FIG. 6 is a side cut-away depiction of the apparatus of FIG. 1 in its expanded state within a bag.
Figure 7:
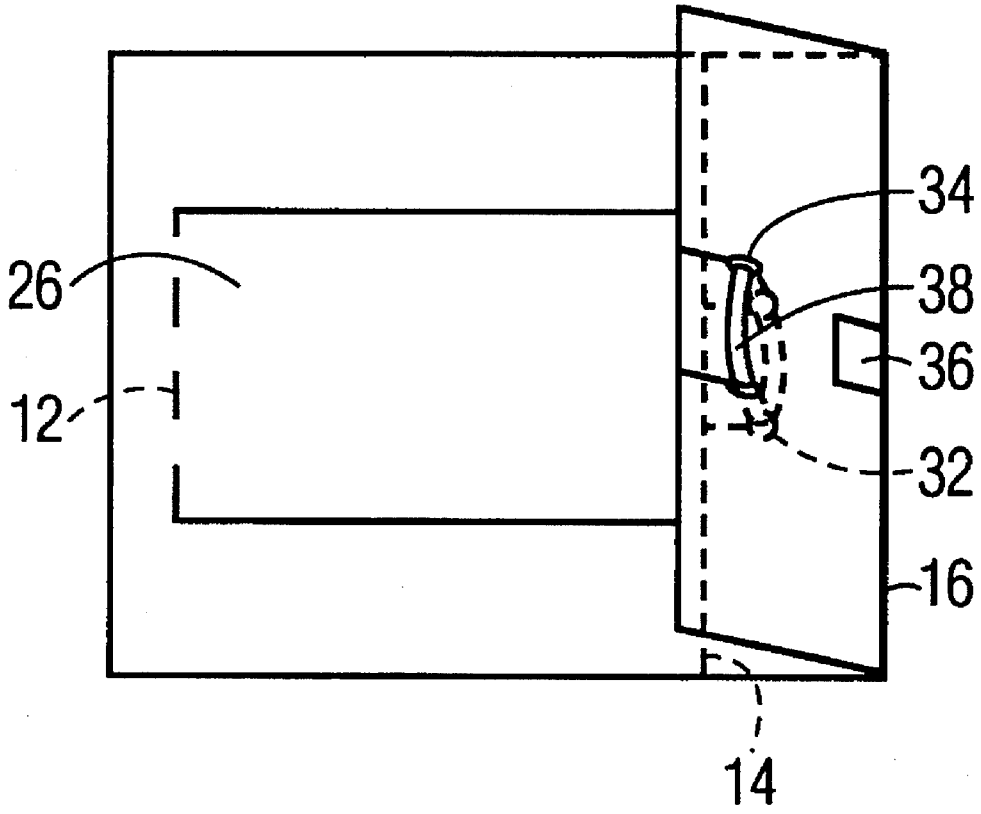
FIG. 7 is a top plan view of an alternative embodiment.

Upon release of the compressive force, i.e. removal of the bag 60 from its container, the rubber band urges the apparatus into its expanded state as shown with reference to FIGS. 5 and 6. As can be seen, in this state, the elastic band 38 has urged the third and fourth panels 22 and 24 to fold along the fold line 16 therebetween. This in turn causes the large flap 26 to pivot outwardly from fold line 12 and be retained by tab 36. The configuration, as a whole, is a gable-like or triangular shaped structure with the outer frame of the second panel 20 forming one major face, the flap portion 26 of the same panel forming a second major face and the third and fourth panels 22 and 24 folded together to form the base, Uniform bag expansion is generally achieved without the need for supplemental rigid inserts as is required in many prior art configurations of bag expanders. However, such rigid inserts may be added to the expanded bag, if desired.

While specific embodiments have been described, all modifications and equivalents of such embodiments which fall within the principles of the invention are intended to be covered within the spirit and scope of the invention by the appended claims.

What is claimed is:

1. A bag expanding apparatus in combination with a soft bag comprising:

a soft bag having a major surface, a base and an expandable compartment such that the bag can assume a collapsed, flat state or an expanded state;

a bag expanding apparatus inserted in the compartment such that the bag can assume its collapsed shape during shipping in a shipping container, and then be caused to assume its expanded shape upon removal from the shipping container, the bag expanding apparatus comprising a unitary, flat foldable member having resilient actuating means associated therewith for urging the member to fold into a predetermined shape, said member having first, second and third parallel, spaced fold lines so as to form four panels including a first narrow panel, a second, wide panel adjacent to the first panel with the first fold line therebetween, said second panel having a centrally located flap extending the width of the second panel, said flap being hinged at the fold line between said first and second panels, a third panel adjacent the second panel having the second fold line therebetween and having a width so as to fit into the base of the bag; a fourth panel adjacent the third panel and having the third fold line therebetween, said fourth panel having a width about the same as that of the third panel; means for securing an elastic member across the third and fourth panels; an elastic member secured across the third and fourth panels to allow the apparatus to be maintained in a relatively flat state when compressed, and to be urged into an expanded state upon removal of compressive forces.

2. The combination recited in claim 1 wherein the second panel of the expanding apparatus conforms to the size and shape of the major surface of the bag.

3. The combination recited in claim 1 wherein the expanding apparatus is made of a rigid material and the elastic member is a rubber band.

4. The combination recited in claim 3 wherein the expanding apparatus is made of corrugated cardboard.

5. The combination recited in claim 1 wherein the fourth panel further comprises a tab hinged at the third fold line which tab engages said flap when in the expanded state.

6. The combination recited in claim 5 wherein the tab is centrally located with respect to the length of the fourth panel.

7. The combination recited in claim 1 wherein said means for securing free elastic members comprise a first pair of parallel slits extending inwardly from the outer edges of the fourth panel and a second pair of parallel slits extending from the second fold line into a portion of the third panel.

8. The combination recited in claim 7 wherein each pair of slits terminates in a retention hole.

9. The combination recited in claim 1 wherein the first fold line extends only the width of the flap.

10. A bag expanding apparatus in combination with a soft bag comprising:

a soft bag having a major surface, a base and an expandable compartment such that the bag can assume a collapsed, flat state or an expanded state;

a bag expanding apparatus inserted in the compartment such that the bag can assume its collapsed shape during shipping in a shipping container, and automatically be caused to assume its expanded shape upon removal from the shipping container, the bag expanding apparatus comprising a unitary, flat foldable member having resilient actuating means associated therewith for urging the member to fold into a predetermined shape, said member having three parallel, spaced fold lines so as to form four panels including a first panel, a second panel adjacent said first panel and separated therefrom by a first fold line, a third panel adjacent the second panel and separated therefrom by a second fold line, and a fourth panel adjacent the third panel and separated therefrom by a third fold line first and second elastic member attachment means, one on each of said third and fourth panels for attaching an elastic member thereacross;

an elastic member attached across said attachment means said elastic member urging the panels to fold along the respective fold lines between said panels to form a pair of gable-like structures in the absence of a compressive force which structures act to expand the bag; and wherein said second panel is of a shape and size essentially equal to that of the major surface of the bag and includes a flap section hinged at the first fold line; said third and fourth panels are essentially the same size and shape of the base of the bag; the elastic member attachment means comprises a pair of parallel slits in each of the third and fourth members; the elastic member is a rubber band; and the fourth panel includes a tab hinged at the third fold line for aiding in the retention of the flap when in the expanded state.

11. A bag expanding apparatus for insertion into a soft bag such that the bag can assume a collapsed shape during shipping in a shipping container, and then be caused to assume an expanded shape upon removal from the shipping container, the bag expanding apparatus comprising a unitary, flat foldable member having resilient actuating means associated therewith for urging the member to fold into a predetermined shape, said member having first, second and third parallel, spaced fold lines so as to form four panels including a first narrow panel, a second, wide panel adjacent to the first panel with the first fold line therebetween, and having a flap extending the width of the second panel, said flap being hinged at the fold line between said first and second panels, a third panel adjacent the second panel having the second fold line therebetween and having a width so as to fit into a base of the bag; a fourth panel adjacent the third panel and having the third fold line therebetween, said fourth panel having a width about the same as that of the third panel; means for securing an elastic member across the third and fourth panels; an elastic member secured across the third and fourth panels to allow the apparatus to be maintained in a relatively flat state when compressed, and to be urged into an expanded state upon removal of compressive forces.

* * * * *